US011166577B2

(12) United States Patent
Ware

(10) Patent No.: US 11,166,577 B2
(45) Date of Patent: Nov. 9, 2021

(54) BEVERAGE COOLING APPARATUS

(71) Applicant: Forgotten Kingdom LLC, Chicago, IL (US)

(72) Inventor: Derek Justin Ware, Chicago, IL (US)

(73) Assignee: FORGOTTEN KINGDOM LLC, Chicago, IL (US)

( * ) Notice: Subject to any disclaimer, the term of this patent is extended or adjusted under 35 U.S.C. 154(b) by 0 days.

(21) Appl. No.: 16/186,199

(22) Filed: Nov. 9, 2018

(65) Prior Publication Data

US 2019/0142194 A1 May 16, 2019

Related U.S. Application Data

(60) Provisional application No. 62/584,639, filed on Nov. 10, 2017.

(51) Int. Cl.

| | |
|---|---|
| ***A47G 21/18*** | (2006.01) |
| ***F25D 31/00*** | (2006.01) |
| ***F25D 3/08*** | (2006.01) |

(52) U.S. Cl.

CPC ..... *A47G 21/187* (2013.01); *F25D 3/08* (2013.01); *F25D 31/002* (2013.01); *F25D 2303/0842* (2013.01); *F25D 2331/805* (2013.01); *F25D 2331/811* (2013.01)

(58) Field of Classification Search

CPC .... F25D 3/08; F25D 31/002; F25D 2331/811; F25D 2303/0842; F25D 2331/805

See application file for complete search history.

(56) References Cited

U.S. PATENT DOCUMENTS

| | | | | |
|---|---|---|---|---|
| 2,194,011 | A * | 3/1940 | Davidson | A47G 19/2266 229/103.1 |
| 5,009,083 | A * | 4/1991 | Spinos | A47G 21/187 62/400 |
| 5,031,831 | A * | 7/1991 | Williams, III | A47G 21/187 239/33 |
| 5,129,238 | A * | 7/1992 | Schwartz | A47G 19/2288 220/904 |
| 8,608,016 | B2 * | 12/2013 | Chiu | A47G 19/2272 220/705 |
| 2007/0137244 | A1 * | 6/2007 | Provencher | A47G 21/187 62/457.3 |
| 2008/0302822 | A1 * | 12/2008 | Tetreault | F25D 3/08 222/146.6 |
| 2015/0028123 | A1 * | 1/2015 | Goldberger | A47G 21/187 239/24 |
| 2017/0367511 | A1 * | 12/2017 | Neff | B65D 43/0204 |

FOREIGN PATENT DOCUMENTS

| | | | | |
|---|---|---|---|---|
| DE | 102008032402 | A1 * | 1/2010 | A47G 21/187 |

* cited by examiner

*Primary Examiner* — Emmanuel E Duke

(57) ABSTRACT

A beverage cooling apparatus includes a straw, a cooling unit, and a coolant material. A cooling receptacle of the cooling unit is filled with the coolant material, which is preferably a food-based organic coolant. The straw is positioned within the cooling receptacle such that a flow-restricting portion of the straw is surrounded by the coolant material. The thermal communication between the flow-restricting portion and the coolant material reduces the overall temperature of the beverage that is being consumed. An attachment panel of the cooling unit is used to establish a connection with varying beverage containers.

3 Claims, 6 Drawing Sheets

BEVERAGE COOLING APPARATUS

The current application claims a priority to the U.S. Provisional Patent application Ser. No. 62/584,639 filed on Nov. 10, 2017.

FIELD OF THE INVENTION

The present invention relates generally to a device that is used for cooling a beverage. More specifically, the present invention is a device that allows the user to consume a beverage at a temperature that is lower than the temperature of the beverage within the container.

BACKGROUND OF THE INVENTION

Cold beverages are the preferred choice during warm weather conditions. Refrigerators, coolers, and ice are usually used to keep the beverages at a preferred temperature. Even though these methods are effective to some extent, there are some notable drawbacks too.

As an example, a refrigerator might not always be available for cooling purposes. Even if a refrigerator is available, the user might not have access to electricity that is required to power the refrigerator. On the other hand, when ice is used, the effectiveness of ice reduces over time due to melting. With both these cooling methods, a beverage container needs to be exposed to cold temperatures so that the temperature of the beverage decreases accordingly. Thus, existing cooling methods might not be as effective when a cold beverage is needed within a short time period.

The objective of the present invention is to address the aforementioned issues. More specifically, the present invention is an apparatus that can cool a beverage even while consuming the beverage. By utilizing the present invention, the user can consume a beverage without waiting for the temperature to decrease to a preferred level.

DETAIL DESCRIPTIONS OF THE INVENTION

All illustrations of the drawings are for the purpose of describing selected versions of the present invention and are not intended to limit the scope of the present invention.

The present invention is a beverage cooling apparatus that can be used to reduce the temperature of a beverage during consumption. More specifically, the present invention eliminates the need to expose a beverage to cold temperatures prior to consumption.

Figure 1:
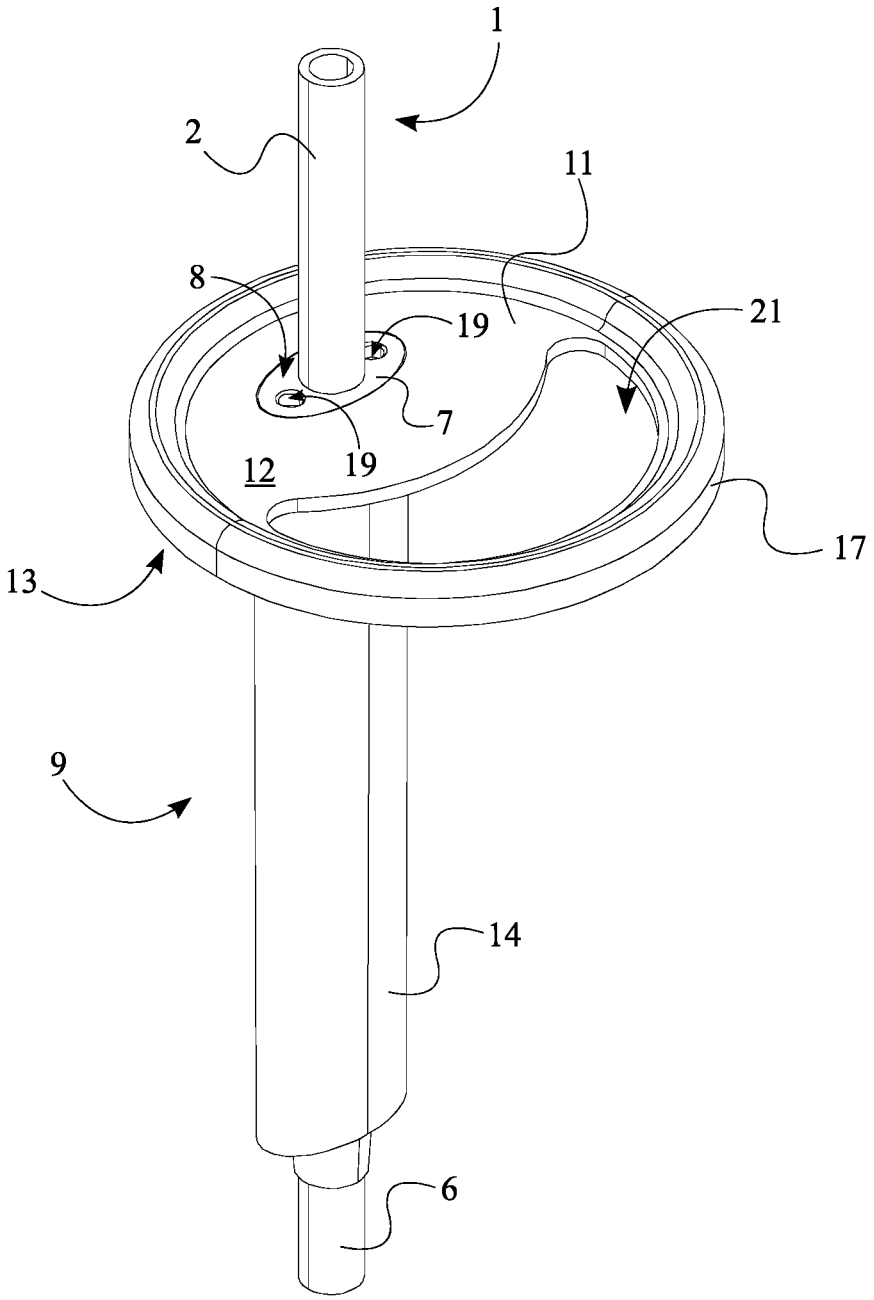
FIG. 1 is a perspective view of the present invention.
Figure 5:
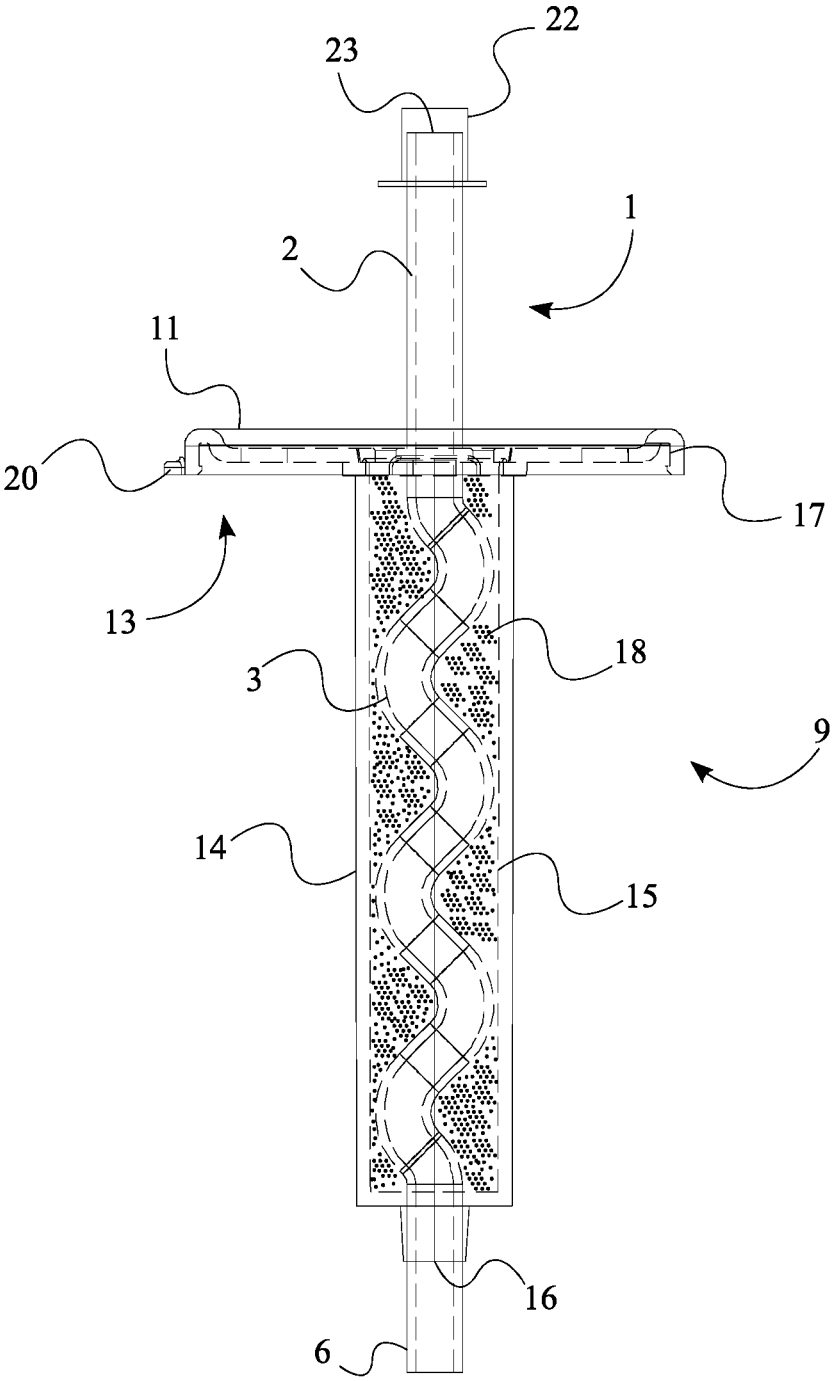
FIG. 5 is a side view of the present invention, wherein the coolant material is illustrated.

As seen in FIG. 1 and FIG. 5, to fulfill the intended functionalities, the present invention comprises a straw 1, a cooling unit 9, and a coolant material 18. The straw 1 is used to draw a beverage out from a beverage container. The cooling unit 9 holds the coolant material 18 that is used to reduce the temperature of the beverage while being drawn out of a container.

Figure 2:
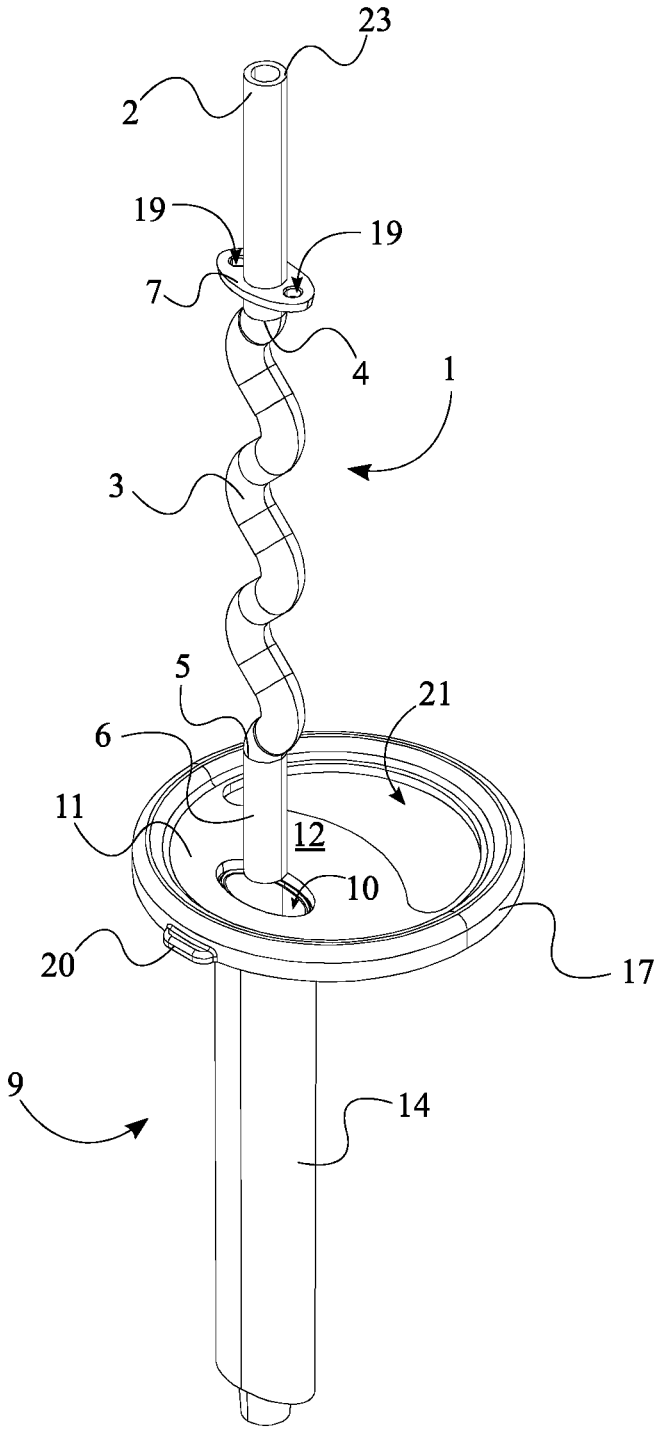
FIG. 2 is an exploded perspective view of the present invention.
Figure 3:
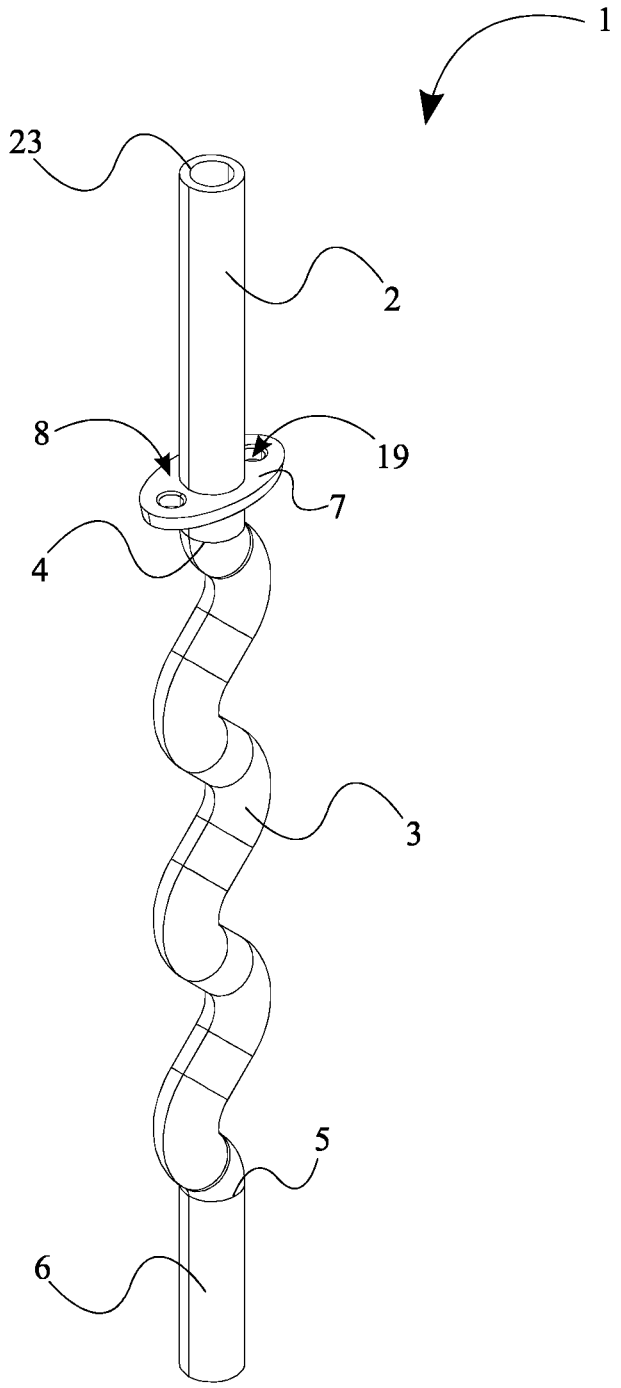
FIG. 3 is a perspective view of the straw.

As seen in FIG. 2 and FIG. 3, the straw 1 used to draw the beverage out of a beverage container comprises an external-drawing portion 2, a flow-restricting portion 3, and an internal-drawing portion 6. The internal-drawing portion 6 is positioned within the beverage container and initiates the process of drawing the beverage from within the beverage container. A volume of beverage drawn at the internal-drawing portion 6 flows through the flow-restricting portion 3 and into the external-drawing portion 2. The user consumes the beverage at the external-drawing portion 2. To do so, the external-drawing portion 2 is terminally connected to a first end 4 of the flow-restricting portion 3. On the other hand, the internal-drawing portion 6 is terminally connected to a second end 5 of the flow-restricting portion 3 such that the flow-restricting portion 3 is positioned in between the external-drawing portion 2 and the internal-drawing portion 6. The connection between the internal-drawing portion 6, the flow-restricting portion 3, and the external-drawing portion 2 transfers the volume of beverage through the straw 1.

Figure 4:
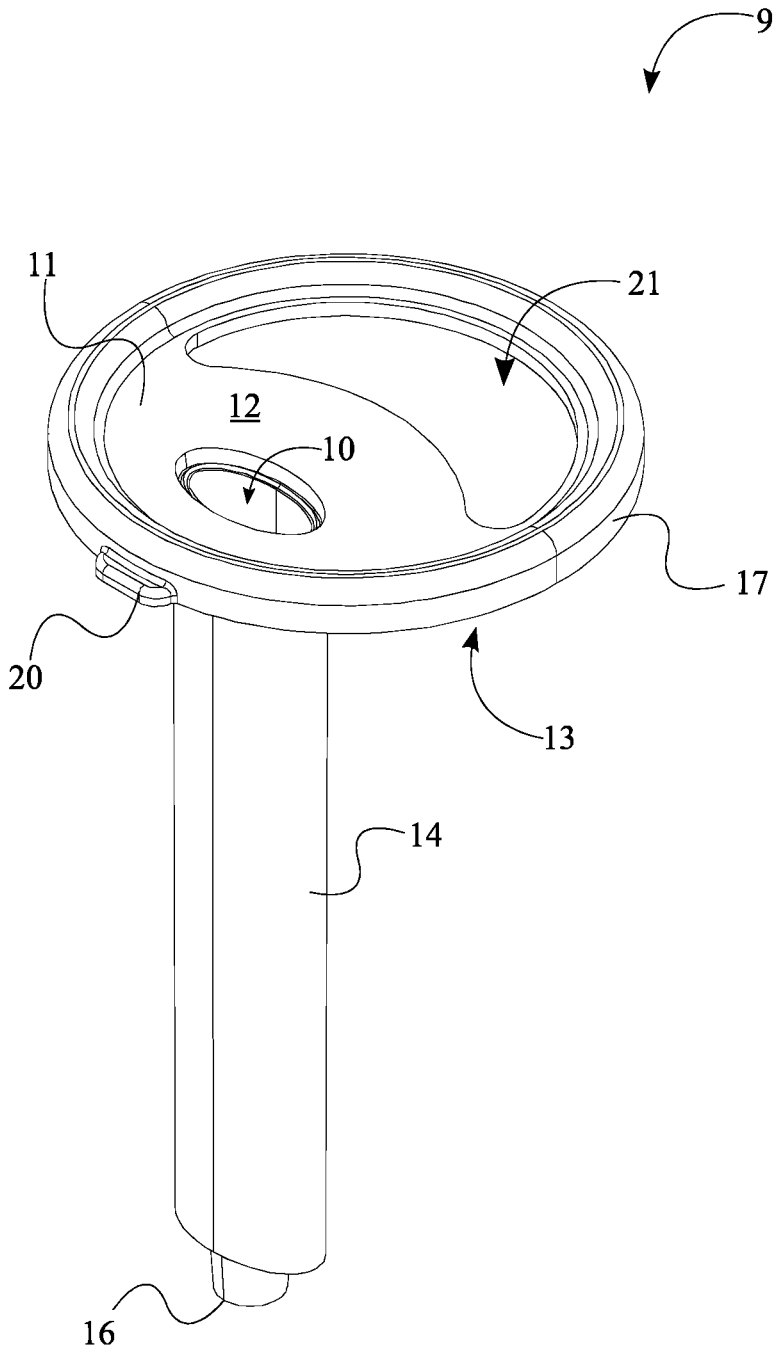
FIG. 4 is a perspective view of the cooling unit.
Figure 6:
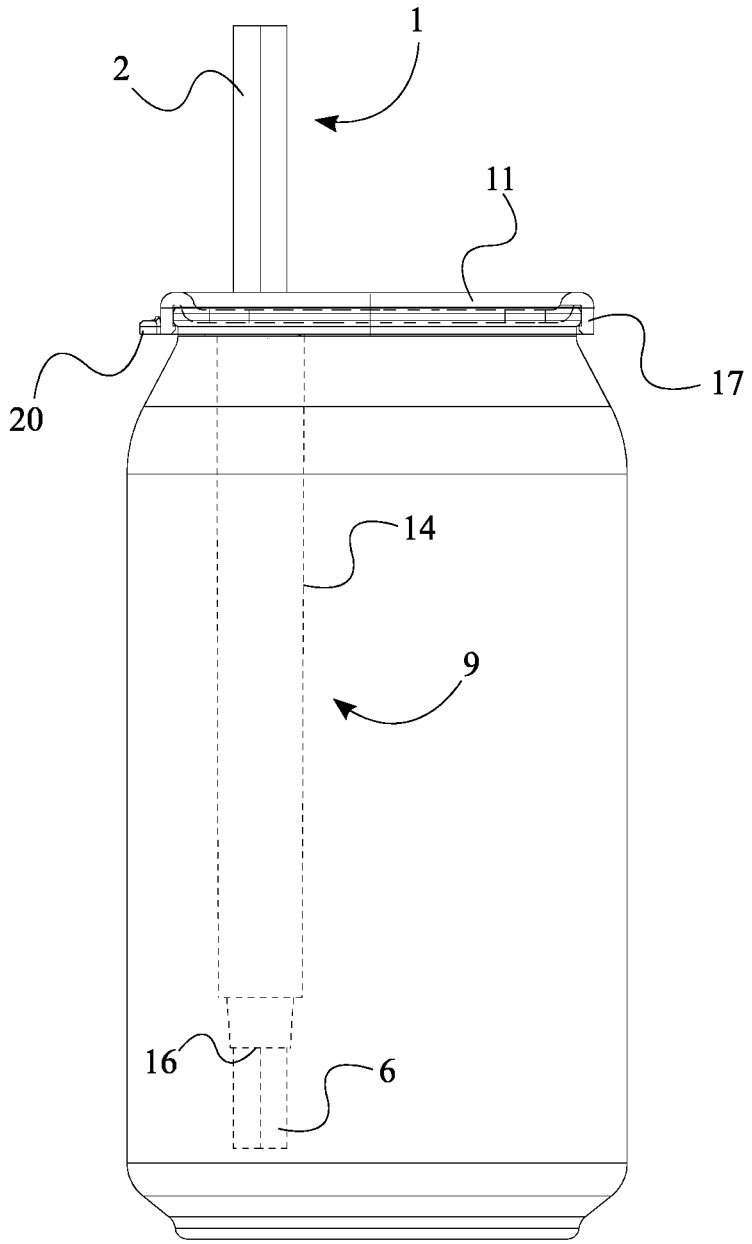
FIG. 6 is a side view of the present invention being used with a beverage can.

As seen in FIG. 4, to reduce the temperature of the volume of beverage passing through the straw 1, the cooling unit 9 comprises an opening 10, an attachment panel 11, and a cooling receptacle 14. The cooling receptacle 14 is used to hold the coolant material 18 and the straw 1. The attachment panel 11 is used to establish a connection with the beverage container. The size and overall shape of the attachment panel 11 can vary in different embodiments of the present invention. Thus, the present invention can be used with beverage containers that can be, but are not limited to, cans and bottles. The opening 10 is used to insert the straw 1 into the cooling receptacle 14. To do so, the opening 10 perpendicularly traverses through the attachment panel 11 into the cooling receptacle 14, wherein the cooling receptacle 14 is terminally and perpendicularly connected to a bottom surface 13 of the attachment panel 11. The attachment panel 11 and the cooling receptacle 14 are positioned and connected such that the attachment panel 11 can be attached to a rim of the beverage container. As seen in FIG. 6, the connection between the attachment panel 11 and the cooling receptacle 14 also allows the cooling receptacle 14 to be positioned within the beverage container. More specifically, if the present invention is being used with a beverage can, the cooling receptacle 14 will be positioned within the beverage can. On the other hand, if the present invention is being used with a bottle, the cooling receptacle 14 will be positioned within the bottle. When the straw 1 is inserted into the opening 10, the flow-restricting portion 3 is surrounded by a lateral section 15 of the cooling receptacle 14. Moreover, the internal-drawing portion 6 traverses through a base section 16 of the cooling receptacle 14 such that the internal-drawing portion 6 is in contact with the beverage within the beverage container.

As discussed, the coolant material 18 is used for cooling purposes. When in use, the cooling receptacle 14, which holds the straw 1, is filled with the coolant material 18. Since the flow-restricting portion 3 is surrounded by the lateral section 15 of the cooling receptacle 14, the flow-restricting portion 3 is in thermal communication with the coolant material 18. As a result, the volume of beverage flowing through the flow-restricting portion 3, transmits heat into the coolant material 18 while flowing from the internal-drawing portion 6 to the external-drawing portion 2. Thus, the volume of beverage consumed by the user has a lower temperature at the external-drawing portion 2 than at the internal-drawing portion 6.

To fill the cooling receptacle 14 with the coolant material 18, which is preferably a food-based organic coolant, the present invention further comprises at least one coolant-filling aperture 19 and the straw 1 further comprises a collar portion 7. The coolant material 18 can be, but is not limited to, corn syrup. The at least one coolant-filling aperture 19 perpendicularly traverses through a structural body 8 of the collar portion 7. In addition to positioning the at least one coolant-filling aperture 19, the collar portion 7 is also used to close the opening 10 when the straw 1 is inserted into the cooling receptacle 14 through the opening 10. To do so, the collar portion 7 is perimetrically connected to the flow-restricting portion 3 at the first end 4. To removably position the collar portion 7 into the opening 10, the shape of the collar portion 7 will be consistent with the shape of the opening 10. As an example, if the opening 10 is oval in shape, the collar portion 7 will also be oval in shape so that the collar portion 7 fits within the opening 10.

When in use, the present invention is attached to the beverage container through the attachment panel 11. As seen in FIG. 5, to maintain a firm connection with the beverage container, the cooling unit 9 further comprises a rim-holding latch 17 that is connected along a perimeter of the attachment panel 11. The overall shape and design of the rim-holding latch 17 can vary from one embodiment to another. With varying embodiments of the rim-holding latch 17, the present invention can be used with beverage containers that can be, but are not limited to, cans and bottles.

As seen in FIG. 2 and FIG. 4, the present invention further comprises at least one gripping protrusion 20 that helps the user control the attachment panel 11. The at least one gripping protrusion 20 is especially beneficial when removing the attachment panel 11 from the beverage container. To do so, the at least one gripping portion 20 is laterally connected to the rim-holding latch 17.

As mentioned before, the present invention can be used with beverage containers that can be, but are not limited to, cans and bottles. A beverage can is opened by controlling a pop-tab positioned on a top surface of the beverage can. To be used with a beverage can without being obstructed by the presence of the pop-tab, the present invention further comprises a tab-receiving slot 21 that perpendicularly traverses through a structural body 12 of the attachment panel 11. As seen in FIG. 1, FIG. 2, and FIG. 4, the tab-receiving slot 21 is positioned adjacent the opening 10 of the cooling unit 9 so that the pop-tab can be appropriately positioned.

To protect the drinking end of the external-drawing portion 2, the present invention further comprises an end cap 22 in another embodiment of the present invention. Since the user utilizes the external-drawing portion 2 to consume the beverage, the end cap 22 is removably attached to a proximal end 23 of the external-drawing portion 2. When the user is about to consume the beverage, the end cap 22 can be removed from the proximal end 23 exposing the proximal end 23.

When the present invention is in use, the following process flow is generally followed. Initially, the straw 1 is inserted into the cooling receptacle 14 of the cooling unit 9. In doing so, the internal-drawing portion 6 is positioned through the base section 16 of the cooling receptacle 14. When appropriately positioned, the collar portion 7 of the straw 1 will be snugly fit within the opening 10, and the flow-restricting portion 3 will be surrounded by the lateral section 15 of the cooling receptacle 14. When the straw 1 is positioned as required, the coolant material 18 is inserted through the at least one coolant-filling aperture 19 into the cooling receptacle 14. Next, the internal-drawing portion 6 and the cooling receptacle 14 are positioned within the beverage container so that the internal-drawing portion 6 is in contact with the beverage. The attachment panel 11 is positioned such that the rim-holding latch 17 is connected to the rim of the beverage container.

Although the invention has been explained in relation to its preferred embodiment, it is to be understood that many other possible modifications and variations can be made without departing from the spirit and scope of the invention as hereinafter claimed.

What is claimed is:

1. A beverage cooling apparatus comprising:

a straw;

a cooling unit;

an organic coolant material;

the straw comprising a collar portion, an external-drawing portion, a flow-restricting portion, and an internal-drawing portion;

the cooling unit comprising a tab-receiving slot, at least one gripping protrusion, a rim-holding latch, an opening, an attachment panel, and a cooling receptacle;

the external-drawing portion being terminally connected to a first end of the flow-restricting portion;

the collar portion being perimetrically connected to the flow-restricting portion at the first end;

the internal-drawing portion being terminally connected to a second end of the flow-restricting portion;

the flow-restricting portion being positioned in between the external-drawing portion and the internal-drawing portion;

the cooling receptacle being terminally and perpendicularly connected to a bottom surface of the attachment panel;

the opening perpendicularly traversing through the attachment panel into the cooling receptacle;

the flow-restricting portion being surrounded by a lateral section of the cooling receptacle;

the collar portion being removably positioned into the opening;

the internal-drawing portion traversing through a base section of the cooling receptacle;

the cooling receptacle being filled with the organic coolant material;

the flow-restricting portion being in thermal communication with the organic coolant material;

the collar portion comprising a structural body and at least one coolant-filling aperture;

the at least one coolant-filling aperture perpendicularly traversing through the structural body;

the rim-holding latch being connected along a perimeter of the attachment panel;

the at least one gripping protrusion being laterally connected to the rim-holding latch;

the tab-receiving slot perpendicularly traversing through the structural body; and the tab-receiving slot being positioned adjacent the opening.

2. The beverage cooling apparatus as claimed in claim 1 further comprises:

an end cap; and the end cap being removably attached to a proximal end of the external-drawing portion.

3. The beverage cooling apparatus as claimed in claim 1, wherein the organic coolant material is a food-based organic coolant.

* * * * *